United States Patent [19]

Björkqvist et al.

[11] 4,109,577

[45] Aug. 29, 1978

[54] DEVICE FOR BOTTOM UNIT FOR PROJECTILE

[75] Inventors: Nils Gunnar Björkqvist; Hans Arne Edgar Franzén; Karl Ingmar Wenzel Johansson, all of Karlskoga, Sweden

[73] Assignee: AB Bofors, Bofors, Sweden

[21] Appl. No.: 697,899

[22] Filed: Jun. 21, 1976

[30] Foreign Application Priority Data

Jul. 4, 1975 [SE] Sweden ..... 7507705

[51] Int. Cl.[2] ..... F42B 4/12

[52] U.S. Cl. ..... 102/35.6; 102/60; 102/66

[58] Field of Search ..... 102/6, 60, 66, 87, 90, 102/34.4, 35 R, 35.2, 35.4, 35.6, 37.6, 95, 42

[56] References Cited

U.S. PATENT DOCUMENTS

| | | | |
|---|---|---|---|
| 236,304 | 1/1881 | Carney | 102/95 |
| 2,342,096 | 2/1944 | Zimmerman | 102/35.6 |
| 3,724,380 | 4/1973 | Simmons | 102/35.6 |
| 3,956,990 | 5/1976 | Rowe | 102/34.4 |

FOREIGN PATENT DOCUMENTS

| | | | |
|---|---|---|---|
| 423,588 | 6/1947 | Italy | 102/35.6 |

*Primary Examiner*—Harold Tudor
*Attorney, Agent, or Firm*—Pollock, Vande Sande & Priddy

[57] ABSTRACT

The bottom plug of a projectile is provided with a radially extending recess which houses a conforming plate which is ejected from the recess when the projectile charge ignites and expels the bottom plug, thereby causing the bottom plug to become eccentric and move out of the path of the flare or other contents of the projectile.

7 Claims, 3 Drawing Figures

DEVICE FOR BOTTOM UNIT FOR PROJECTILE

BACKGROUND OF THE INVENTION

The present invention relates to a device for a bottom unit for a projectile which can be fired through actuation by a propelling charge and which comprises a tubular part which contains a space for e.g. an illuminating or smoke charge attached to a parachute. At the firing of the projectile, the propelling charge is arranged to develop a gas pressure which actuates the projectile via the bottom unit, which is applied at one end of the tubular part and drives the projectile out of the barrel.

It is the intention that said illuminating or smoke charge, at a predetermined time after the firing of the projectile, is to be released and then ignited and, suspended in a parachute, fall to the ground. The bottom unit is then to be separable from the tubular part of the projectile when the charge attached to the parachute is expelled from the carrying part.

In order to avoid damage being caused by a separated bottom part to the parachute or its payload, it is known in the art to make a bottom plate eccentric, so that as a consequence of the angular rotation it obtains in the projectile around the line of symmetry, it is given a course that deviates from the course of the load carried by the parachute. However, it has been proved that the eccentricity of the bottom plate which is required in order that the deviation from the course shall be of the size desired, jeopardizes the function of the projectile itself. In order that the bottom plate shall withstand the high gas pressure to which it is subjected at the instant of firing, it must constitute a heavy and solid unit, and as a result of this the entire projectile will be eccentric in its rotation, i.e. it will rotate around an axis that deviates from the axis of symmetry. This can cause incorrect function of the time fuze which is preferably located in the nose of the projectile, resulting either in a failure to release the pyrotechnical charge, or a release of the charge at the wrong time.

To eliminate the above-mentioned disadvantages, it is known to make the bottom plate of a number of parts, the surfaces of the sections of which extend between the outside and inside of the plate, the bottom plate then being provided on its outside with a cover that extends at least over the sections between the parts of the bottom plate, and holds these together. The cover then also prevents gas from entering into the space through the sections. At the expulsion of the charge from the space in the projectile, the parts in the bottom plate will be thrown out from the course of the charge, each in a different direction, as a result of the centrifugal force that arises from the rotation of the plate around the axis of symmetry. The cover is particularly made light, so that it will be retarded considerably by the air resistance when the charge is expelled, which reduces the risk that it may damage the parachute.

In the case of heavy projectiles, however, in certain cases, it has been proved that the cover is not capable of keeping the parts of the bottom plate together sufficiently, resulting in internal displacements of the parts and, as a consequence of this, there will not be satisfactory obturation. To make the cover heavier would then not be an appropriate solution, as the cover would then be more likely to damage the payload after it has been expelled.

SUMMARY OF THE INVENTION

The present invention relates to a device which, in a simple way, eliminates the above-mentioned disadvantages. The feature that can primarily be considered to characterize the invention is that the bottom unit is composed of a substantially cylindrical main part and a centering weight which can be separated from a recess in the envelope surface of the cylindrical part, the weight being of such a size that the bottom unit is centric in the projectile during the trajectory but is eccentric after the instant of separation, as the centering weight, due to the centrifugal force arising from the rotation of the projectile, is separated from the main part, the bottom parts then obtaining a lateral movement.

BRIEF DESCRIPTION OF THE DRAWINGS

An embodiment proposed at present which has the characteristics significant for the invention will be described in more detail with reference to the accompanying drawings, in which FIG. 1, in a side view, shows a projectile partly in cross-section, with a bottom unit applied at one end of the tubular part in the projectile.

Figure 1:
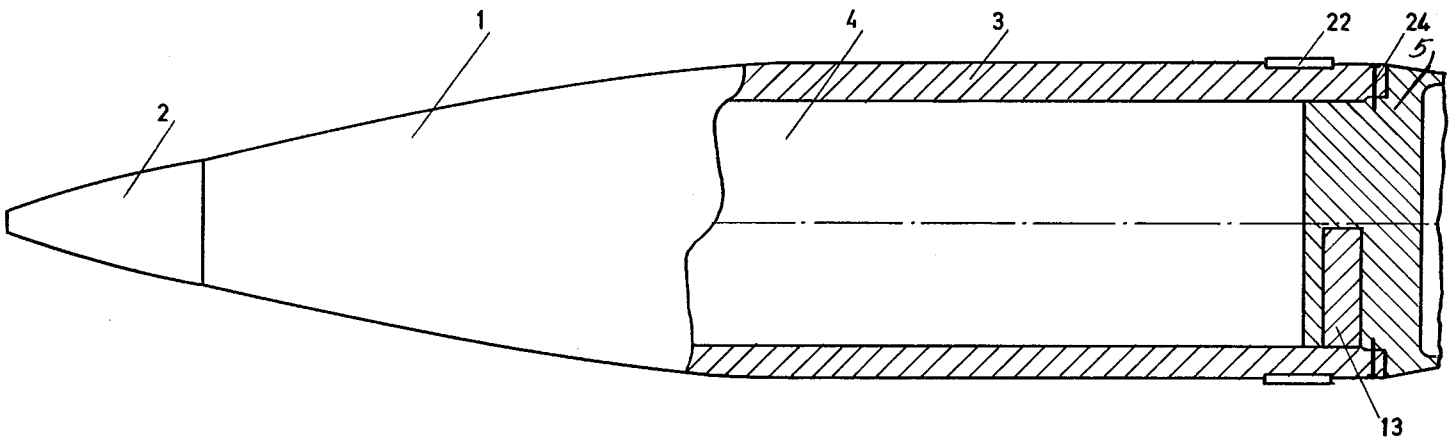

The projectile 1 shown in FIG. 1 comprises a front part 2, a tubular part 3 which contains a space 4 in which, for instance, a pyrotechnical illuminating charge or a smoke charge can be placed, and a rear part in or plug the form of a bottom unit 5. The front part appropriately contains a time fuze which, at a predetermined period of time after the firing of the projectile, releases and thereafter ignites said illuminating or smoke charge which, thereafter, suspended in a parachute, is allowed to fall to the ground.

The projectile 1 is intended to be fired from a barrel with the time of aid of a propelling charge (not shown) which at the firing develops a gas pressure which actuates the projectile via the outside of the tubular part, primarily at the rear end of the projectile, as well as via the bottom unit 5.

Figure 2:
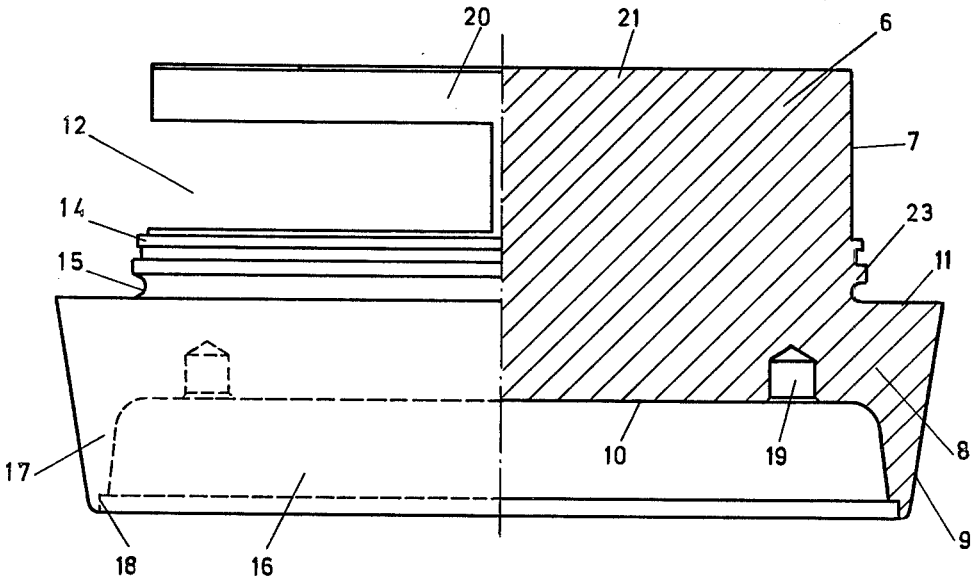
FIG. 2, shows a detailed view of the main part of the bottom unit, partly in cross-section.

FIG. 2 shows, in more detail, the bottom unit 5 disengaged from the projectile 1. As will be noted from the Figure, the bottom unit 5 substantially consists of a thick, solid circular disc, comprising a front cylindrical part portion 6, the envelope surface 7 of which has a smaller diameter and is in contact with the rear part of the inner surface of the tubular part 3, and a rear, tapered portion 8, the envelope surface 9 of which has a larger diameter and is shaped so as to constitute a tapered extension of the outer surface of tubular part 3. Between the two surfaces 7 and 9 a ring-formed shoulder 11 is shaped, which is in contact with the end surface of the tubular part 3 and absorbs the pressure from the propellant gases acting upon the rear surface 10 of the bottom unit.

The bottom unit 5 is composed of two parts, in that the cylindrical part 6, in its cylindrical envelope surface, has a recess 12 with a substantially semicircular plate 13, which fills the recess and conforms in shape to the envelope surface 7.

The envelope surface 7 is provided with threads 14, so that the plate can be screwed into the tubular part 3, and a groove 15 in which an O-ring can be placed for obturation between the bottom unit and the tubular part. Beside the groove 15 there is a circular supporting strip 23 which, in addition to its securing the O-ring seal has a supporting function inasmuch as it is in contact with the inner surface of the tubular part. In Figure 1, it is also shown that the bottom unit can be secured to the tubular part with the aid of pins 24.

The rear part of the bottom unit, the outer form of which is like a truncated cone with its wider part facing the end surface of the tubular part, is provided with a circular recess 16 in its narrower transversal surface, located farthest to the rear. The recess extends through the major portion of the end surface, and is slightly tapered, so that a ring-formed section 17, tapering out rearwardly, is formed by the rear part of the bottom plate. The outermost part of the ring-formed section is formed with a chamfer 18, which serves as an energy-absorbing deformation zone to lessen the stresses on the bottom closure in case of a fall on the bottom, for instance during transport or storage. The recess 16 is of significance from the point of view of weight, as the total weight of the projectile can be regulated by making the recess with different depths. The bottom of the recess is provided with a wrench grip 19, in order to facilitate the fitting of the bottom unit in the projectile.

The recess 12 for the semicircular plate 13 is placed in such a way in the cylindrical part 6 that an unbroken, circular section 20 is formed between the recess and the end surface 21 of the cylindrical part. The unbroken section has a supporting effect on the tubular part 3, which is of importance particularly at the instant of firing, when the tubular part is subjected to a gas pressure and forcing forces. In order to further increase the strength, the cylindrical part has such a length that said unbroken section will be located under the driving band 22 of the projectile, i.e. the member which through coaction with the rifling in the barrel achieves rotation of the projectile (see FIG. 1). In order to avoid damage to the pyrotechnical charge time of the separation, when the bottom unit is given a lateral movement, the front end surface (21) is flat and smooth.

From FIG. 2, it will also be noted that the recess 12 is placed in such a way that the threads, including the O-ring seal, will be located behind the recess 12 (in relation to the direction of flight of the projectile). This is of significance from the point of view of obturation, as the gases developed at the firing of the projectile are then prevented from entering into the space via the surfaces of the sections of the parts.

Figure 3:
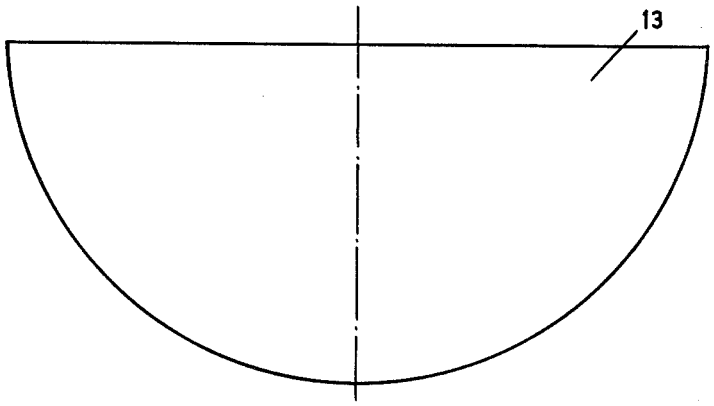
FIG. 3 shows a view of the separable centering weight, made in the form of a substantially semicircular plate.

FIG. 3 shows separately the plate 13 which can be placed in the recess 12, which adapts itself to the inner surfaces of the recess with a good fit. The plate then has such a weight that the bottom unit is centric while the projectile is in its trajectory. At the instant of separation, however, the centricity of the bottom unit ceases, as the plate is separated from the main part, and the two parts obtain a lateral movement so that a collision between the bottom unit and the canister is prevented.

The invention is not limited to the embodiment shown above as an example, but can be subject to modifications within the scope of the accompanying claims.

We claim:

1. An improved bottom plug for a projectile of the type having a tubular casing defining an interior space closed at its bottom end by said bottom plug, said space enclosing a smoke or illuminating charge and an expulsion charge for forcing said bottom plug and said smoke or illuminating charge from said casing, said bottom plug comprising:

a first part having a substantially cylindrical outer envelope surface portion configured to fit within and close said bottom end of said casing, and an end surface also defining said interior space;

said first part defining a recess extending within said first part and opening only through its said cylindrical envelope surface portion to form an unbroken cylindrical surface for said bottom plug between said recess and said end surface at said first part;

and a second part comprising a centering weight located within said recess, each of said first and second parts being eccentric relative to a central rotational axis of the projectile but jointly forming when said centering weight is in said recess, a substantially centric mass relative to said axis;

whereby said second part is normally maintained within said recess but moves laterally out of the path of said smoke or illuminating charge in response to centrifugal forces when said bottom plug separates from said casing.

2. A device according to claim 1, wherein said recess is formed rearwardly in the direction of projectile flight from the forward end of said first part to provide support for the walls of said casing.

3. A device according to claim 2, wherein the forward end surface of said first part is flat.

4. A device according to claim 1, wherein said first part comprises a front cylindrical portion with a cylindrical outer envelope surface in contact with the inner surface of said casing and a rear, tapered portion with a cylindrical envelope surface which forms a tapered extension of the outer surface of said casing.

5. A device according to claim 4, wherein said centering weight is a substantially semicircular plate which fills said recess and conforms its outer shape to the cylindrical envelope surface of said first part.

6. A device according to claim 4, wherein said cylindrical envelope surface of said first part comprises threads for screwing the bottom plug into said casing, said threads being located on a circular section formed between said recess and said rear, tapered portion.

7. A device according to claim 4, wherein said rear tapered portion of said first part comprises a thin annular ring portion at its rearmost end comprising a deformation zone which lessens the stresses on the bottom plug in case of a fall on the bottom.

* * * * *